US006549754B1

(12) United States Patent
Miller et al.

(10) Patent No.: US 6,549,754 B1
(45) Date of Patent: Apr. 15, 2003

(54) PASSENGER ENTERTAINMENT SYSTEM HAVING DOWNCONVERTER CONTROL SIGNALS AND POWER SUPPLIED OVER OUTPUT CABLES

(75) Inventors: Scott D. Miller, Upland, CA (US); Ralph Phillipp, Huntington Beach, CA (US); Curtis J. Larson, Cedar Rapids, IA (US); James L. Bartlett, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/318,370

(22) Filed: May 25, 1999

(51) Int. Cl.[7] ..... H04H 1/00
(52) U.S. Cl. ..... 455/3.02; 455/3.06; 455/131
(58) Field of Search ..... 455/3.01–3.06, 455/130, 131; 342/359; 725/62, 63, 68–70

(56) References Cited

U.S. PATENT DOCUMENTS 5,301,352 A * 4/1994 Nakagawa et al. ..... 455/132
5,345,591 A * 9/1994 Tsurumaki et al. ..... 455/3.2
5,760,819 A * 6/1998 Sklar et al. ..... 342/363
5,790,175 A 8/1998 Sklar et al. ..... 348/8
5,797,083 A * 8/1998 Anderson ..... 342/359
5,801,751 A 9/1998 Sklar et al. ..... 348/8
5,805,975 A * 9/1998 Green et al. ..... 455/12.1
5,959,592 A * 9/1999 Petruzzelli ..... 725/68
H1836 H * 2/2000 Fletcher et al. ..... 455/433
6,229,408 B1 * 5/2001 Jovanovich et al. ..... 333/167
6,272,328 B1 * 8/2001 Nguyen et al. ..... 455/277.1
6,397,038 B1 * 5/2002 Green et al. ..... 455/12.1

OTHER PUBLICATIONS

U.S. patent application Ser. No. 09/085,180 Infiesto et al., filing date of May 26, 1998.

* cited by examiner

*Primary Examiner*—Nguyen T. Vo
*Assistant Examiner*—Edan Orgad
(74) *Attorney, Agent, or Firm*—Nathan O. Jensen; Kyle Eppele

(57) ABSTRACT

An in-flight entertainment system provides live video/audio programming to passengers and operators over an aircraft video/audio distribution system. The programming signals are derived from intermediate frequency (IF) signals that are produced by frequency downconverting satellite broadcast signals and supplied over a pair of IF signal output cables. The control signals and the DC power used in the frequency downconversion process are received over the same IF signal output cables, but in a reverse direction. A bias-T connector is provided in each of the IF signal output cables to extract out the control signals and the DC power.

9 Claims, 4 Drawing Sheets

PASSENGER ENTERTAINMENT SYSTEM HAVING DOWNCONVERTER CONTROL SIGNALS AND POWER SUPPLIED OVER OUTPUT CABLES

BACKGROUND OF THE INVENTION

1. Field of the Invention

The present invention relates generally to in-flight entertainment (IFE) systems, and more particularly to IFE systems that provide on a world-wide basis live video/audio programming to passengers/operators of an aircraft using broadcast signals transmitted in either circular or linear polarized form.

2. Description of the Related Art

Conventional IFE systems, that distribute live video/audio programming to aircraft passengers, such as an Airborne Satellite Television System (ASTS) manufactured by the assignee of the present invention, derive the live video/audio programming signals from a direct broadcast satellite (DBS) that transmits broadcast signals in the form of right and left circular polarized RF signals. For example, U.S. Pat. No. 5,790,175, issued on Aug. 4, 1998, entitled "Aircraft Satellite Television System for Distributing Television Programming Derived From Direct Broadcast Satellites," and U.S. Pat. No. 5,801,751, issued on Sep. 1, 1998, entitled "Distribution of Satellite Television Programs to Passengers in an Aircraft When It Is Out of Range of the Satellites," the disclosures of which are incorporated by reference herein, describe an IFE system that provides live television programming derived from signals broadcast by the DIRECTV DBS system.

Conventional IFE systems, however, are limited because they cannot derive live video/audio programming signals if DBS signals are not in the form of right and left circular polarized RF signals. Although DBS systems that provide service within the continental United States broadcast signals in the form of right and left circular polarized RF signals, DBS systems whose service regions lie outside North and South America generally broadcast signals in the form of horizontal and vertical linear polarized RF signals. For this reason, conventional IFE systems are unable to provide live video/audio programming when the aircraft travels outside the continental United States and into regions serviced by these DBS systems.

In co-pending U.S. Patent Application entitled "Passenger Entertainment System Providing Live Video/Audio Programming Derived from Satellite Broadcasts," the contents of which are incorporated by reference herein, an IFE system that is capable of deriving video/audio programming signals from satellite broadcast signals transmitted in either the circular polarized form or the linear polarized form is disclosed. This system is able to derive the video/audio programming signals from satellite broadcast signals transmitted by satellite constellations within any geographical region, so that live video/audio programming may be distributed to aircraft passengers on a worldwide basis.

SUMMARY OF THE INVENTION

An object of the present invention is to provide an IFE system that derives video/audio programming signals from satellite broadcast signals transmitted either in circular polarized form or linear polarized form, using an intermediate frequency (IF) signal generating unit that receives downconverter control signals and DC power over IF signal output cables.

Another object of the present invention is to provide a method of producing IF signals from satellite broadcast signals using downconverter control signals and DC power that are delivered over IF signal output cables.

The above and other objects are achieved by diplexing the downconverter control signals and DC power onto the IF signal output cables. By using the IF signal output cables as input lines for the downconverter control signals and DC power, the wiring structure is greatly simplified in the IFE system according to the present invention. This results in valuable weight savings for the aircraft. Additionally, the IFE system according to the present invention employs: a pair of bias-T connectors that are arranged in the IF signal output cables. The bias-T connectors permit the IF signals that are generated by the downconverter to be supplied over the output cables in a first direction while extracting the downconverter control signals and DC power that are received in a second direction which is opposite to the first direction.

Additional objects, features and advantages of the invention will be set forth in the description of preferred embodiments which follows.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION OF THE PREFERRED EMBODIMENTS

Figure 1:
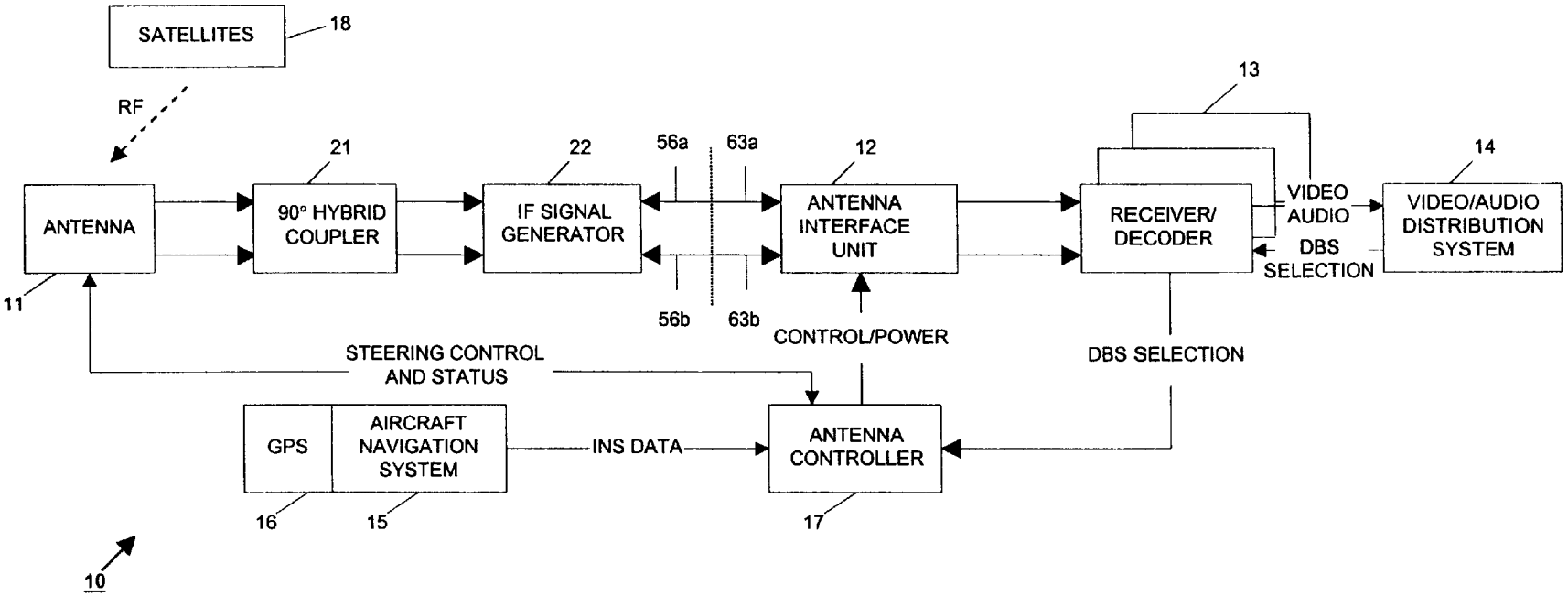
FIG. 1 is a block diagram of an IFE system according to the invention.

FIG. 1 illustrates a top-level block diagram of the first embodiment of a vehicle entertainment system 10 of the p resent invention. The vehicle entertainment system 10 provides live video/audio programming including news, sporting events, movies, and regular commercial programming through a direct broadcast satellite (DBS) 18. It also provides office network services, electronic mail, Internet uplink, videoconference uplink, and weather uplink, et al.

In the description below, the vehicle entertainment system 10 is described as implemented on an aircraft. However, the vehicle entertainment system 10 may be implemented in any vehicle having a passenger entertainment system. Some of the examples include buses, boats, trains, and jetfoils. Also, a description of some of the details of the vehicle entertainment system 10 has been omitted for clarity, and such details may be found in co-pending U.S. patent application Ser. No. 09/085,180, filed May 26, 1998, entitled "Passenger Entertainment System, Method and Article of Manufacture Having Improved Area Distribution Equipment," the contents of which are incorporated by reference herein.

The vehicle entertainment system 10 comprises an antenna 11 that is disposed adjacent the surface of an aircraft, or atop a horizontal or vertical stabilizer of the aircraft. The antenna 11 is steered based on control signals from an antenna controller 17 so that it is pointed at the satellite 18 which is part of an existing DBS system, such as CANAL+, SHOWTIME, DIRECPC or DIRECTV. The operation of the steering control of the antenna 11 is described in U.S. Pat. No. 5,790,175. The antenna 11 may be an electrically steered antenna 11 or a mechanically steered antenna 11.

The antenna 11 includes two linear probes 11*a,* 11*b* (see FIG. 3) that collect the satellite broadcast signals, which are typically transmitted in either the C band (3.4 to 4.2 GHz) or the Ku band (10.7 to 12.75 GHz). The linear probes 11*a,* 11*b* may be implemented as part of a waveguide circuit or a microwave circuit. The antenna 11 collects two orthogonal linear polarizations which are then supplied to a 90° hybrid coupler or combiner 21. The combiner 21 produces output signals corresponding to right and left circular polarized signals received at the antenna 11. In the case of linear polarization reception, the two outputs of the,combiner 21 each contain a portion of the linear signal, depending on the orientation of the antenna probes 11*a,* 11*b* relative to the incident wave polarization. The output signals are then supplied to a frequency downconverter or an intermediate frequency (IF) signal generating unit 22. Depending on the DBS service provider, the IF signal generating unit 22 outputs IF signals corresponding to either right and left circular polarized input signals, or horizontal and vertical linear polarized input signals. These IF signals are supplied to an antenna interface unit 12 over a pair of output transmission lines 56*a,* 56*b.* In the following discussion, the IF signals may be referred to as circular or linear polarized. However, it is to be understood that this means that the IF signals correspond to circular or linear polarized waves as received at the antenna 11.

The IF signals that are supplied to the antenna interface unit 12 are passed onto and processed by a receiver/decoder 13 which demodulates and decodes the IF signals to provide video and audio signals corresponding to a plurality of channels. The video and audio signals for the various channels are then routed to a conventional video and audio distribution system 14 on the aircraft that distributes video and audio services to the passengers and operators. The receiver/decoder 13 may generate either baseband video and analog audio, or digitally compressed video and audio depending on the nature of the distribution system 14. The method of distributing a large number of live television programs by using digitally compressed video and audio is described in U.S. Pat. No. 5,760,819, the contents of which are incorporated by reference herein.

Multiple receivers/decoders: 13 are illustrated in FIG. 1, one for each DBS service provider, because the receiver/decoder 13 must be matched to the provider of the satellite broadcast signals. When the aircraft is flying in a region that is covered by DIRECTV satellites, for example, a matching DIRECTV receiver/decoder must be used to derive the programming signals. The selection among the different DBS service providers may be input manually by an operator of the vehicle entertainment system 10 or generated automatically based on the current global position of the aircraft. In either case, the DBS service selection signal is accomplished by one of the receivers/decoders 13 for generating the video and audio programming signals.

Figure 2:
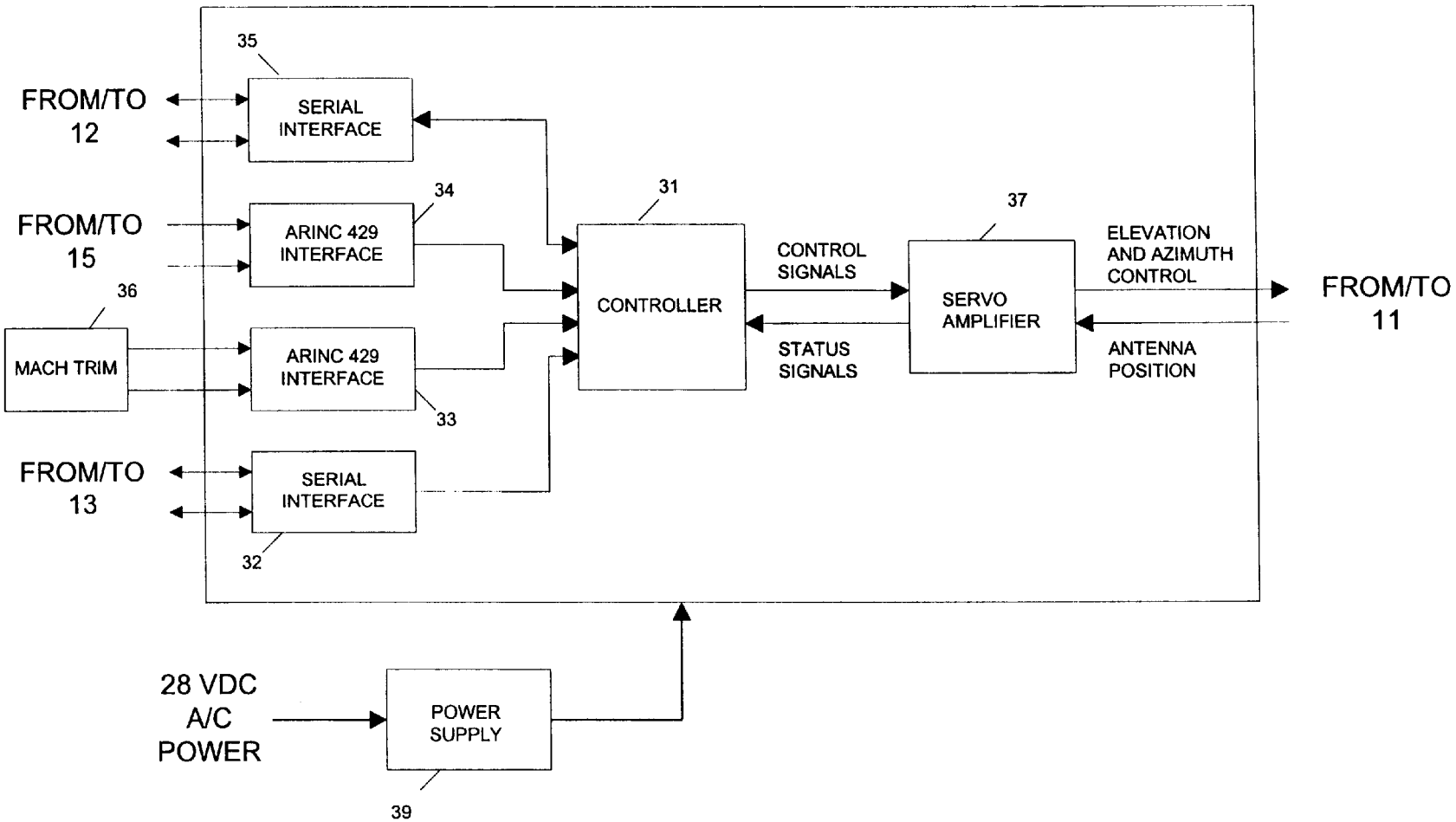
FIG. 2 is a block diagram of an antenna controller employed in the IFE system according to the invention.

FIG. 2 shows a block diagram of the antenna controller 17 employed in the vehicle entertainment system 10 of FIG. 1. The antenna controller 17 comprises a controller 31 that is coupled to two serial interfaces 32, 35, two ARINC 429 interfaces 33, 34, and servo amplifiers 37 for controlling elevation and azimuth angles of the antenna 11. The antenna controller 17 further comprises a power supply 39 that converts 28-volt DC aircraft power into the appropriate DC voltages for the controller 31, the interfaces 32, 33, 34, 35, and the servo amplifiers 37. The controller 31 may be an Intel 486 processor, for example.

The interface 32 couples the antenna controller 17 to the receiver/decoder 13. The DBS service selection signal is supplied from the receiver/decoder 13 through this interface 32. Based on the DBS service selection signal, the controller 31 generates control signals corresponding to the DBS service that is selected. These control signals specify the location of the satellite 18, whether the satellite 18 is broadcasting circular or linear polarized RF signals (circular/linear mode control), the frequency band of satellite transmission, frequency of a local oscillator (LO frequency), and the type of filtering that should be used (filter selection control).

The interface 33 couples the antenna controller 17 to an aircraft mach trim system 36. A trim position of the aircraft's horizontal stabilizer is supplied through this interface 33. This data is used in vehicle entertainment systems where the antenna 11 is mounted on a movable stabilizer, but is not used in vehicle entertainment systems where the antenna is mounted fixed in a relationship to the aircraft body.

The interface 34 couples the antenna controller 17 to the aircraft inertial reference unit or navigation system 15. Inertial reference unit (IRU) signals or inertial navigation system (INS) data corresponding to the aircraft position and attitude are generated by the aircraft navigation system 15 in conjunction with the global positioning system (GPS) 16, and supplied to the controller 31. Based on the INS data, the trim position of the aircraft's horizontal stabilizer (if applicable), the satellite location, and the current antenna position, the controller 31 produces the elevation and azimuth control signals for the antenna 11.

The interface 35 couples the antenna controller 17 to the antenna interface unit 12. A number of different control/status signals are supplied to the antenna interface unit 12 through this interface 35. These signals are control signals for the downconverter and specify whether the satellite 18 is broadcasting circular or linear polarized RF signals (circular/linear mode control), the frequency band of satellite transmission, the LO frequency, and the type of filtering that should be used (filter selection control). The converted DC power is also supplied to the antenna interface unit 12 through this interface 35.

The servo amplifier 37 couples the antenna controller 17 to the antenna 11. The servo amplifier 37 includes an elevation servo amplifier that processes elevation control signals to generate elevation motor drive power that is supplied to the antenna 11, and an azimuth servo amplifier that processes azimuth control signals to generate azimuth motor drive power that is supplied to the antenna 11. The current antenna position is sensed at the antenna 11 and returned to the controller 31 in the form of status signals from the servo amplifiers 37.

Figure 3:
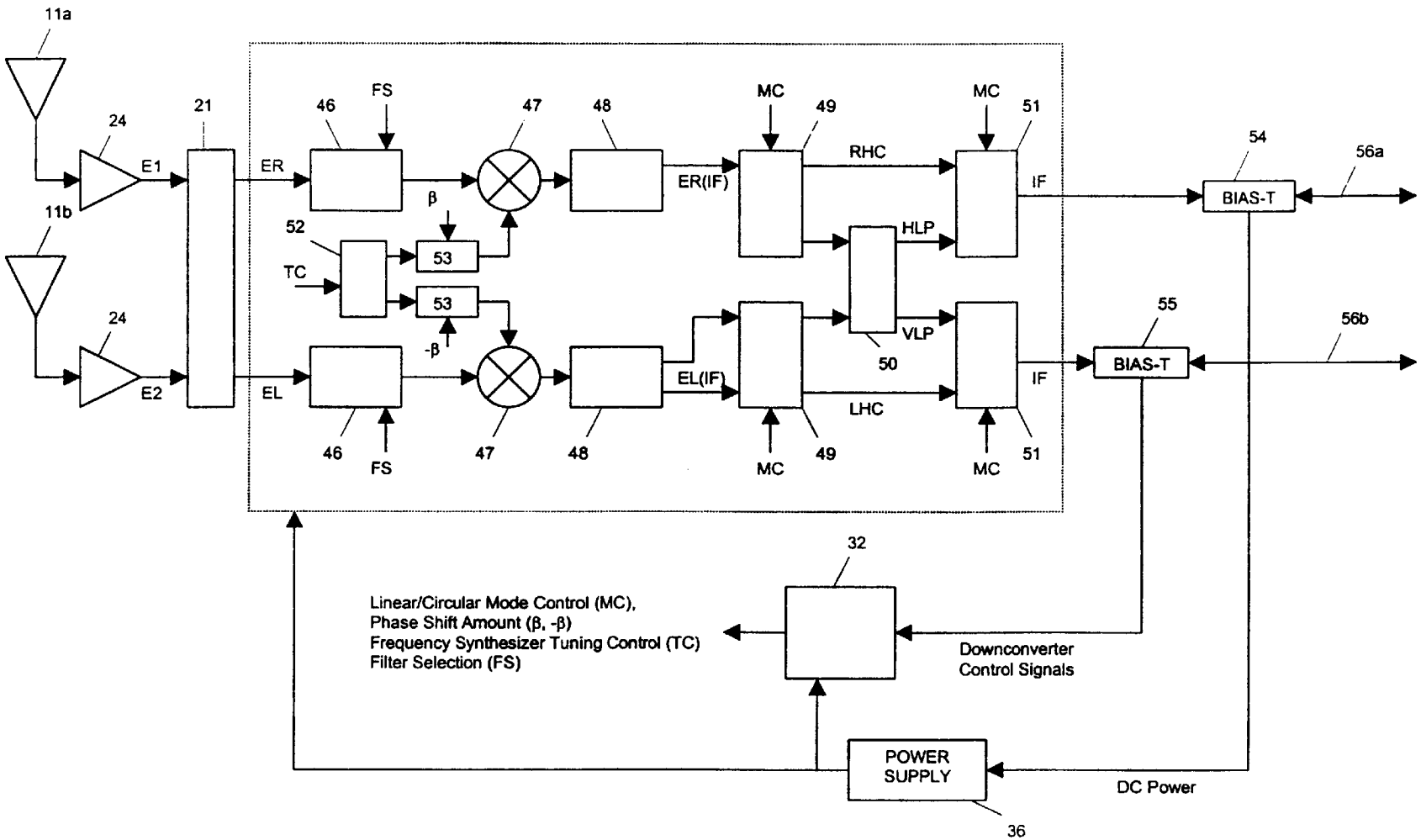
FIG. 3 is a block diagram of antenna probes, a combiner, and a downconverter employed in the IFE system according to the invention.

FIG. 3 shows the frequency downconverter or IF signal generating unit 22 in more detail. The IF signal generating unit 22 includes filters 46, a frequency translator including a pair of mixers 47, filters 48, switches 49, another 90° hybrid coupler or combiner 50, selectors 51, a tunable frequency synthesizer 52, and phase shift circuits 53. The filters 46, mixers 47, and filters 46, 48 operate in the conventional manner, with the exception that the characteristics of the filter 46 may be changed based on filter selection signal FS. The combiner 50 produces horizontal and vertical linear polarized IF signals by combining the appropriately phase-shifted right and left circular polarized IF signals. The selectors 51 selectively pass through either the circular or linear polarized IF signals. The phase shift circuits 53 apply positive and negative phase shift amounts to a local oscillator (LO) signal generated by the frequency synthesizer 52.

FIG. 3 further illustrates the two linear probes 11*a,* 11*b* that are part of the antenna 11. The linear probes 11*a,* 11*b* are positioned 90° relative to each other and their output signals are supplied to low noise amplifiers 24 which generate amplified signals E1, E2. The amplified signals E1, E2 are then supplied to the combiner 21 which produces output signals ER and EL according to the formula:

$$ER=(E1+E2\angle-90°)/\sqrt{2} \quad [1]$$

$$EL=(E2+E1\angle-90°)/\sqrt{2} \quad [2]$$

The signals ER, EL are bandpass filtered by the filters 46 and frequency downconverted by the mixers 47 using the LO signal generated by the frequency synthesizer 52. The downconverted IF signals are then low-pass filtered using the filters 48 and passed through switches 49. The switch outputs, RHC and LHC, represent the right and left circular polarized IF signals, respectively, and after passing through the selectors 51, are used directly when receiving circular polarized signals.

When a DBS service provider broadcasting linear polarized signals is used, positive and negative phase shift amounts are added respectively to the LO signal generated by the frequency synthesizer 52 before the LO signal is mixed with the circular polarized signals for frequency downconverting. The operation carried out by the mixers 47 can be expressed as:

$$ER(IF)=ER\times LO\angle+\beta \quad [3]$$

$$ER(IF)=ER\times LO\angle-\beta, \quad [4]$$

where ER(IF) and EL(IF) represent the right and left circular polarized signals in the IF band, respectively. The positive and negative phase shifts have the same magnitude and compensate for the fact that the horizontal and vertical axes of the linear polarized signals broadcast by the satellite 18 are not aligned with the probes 11*a,* 11*b*.

The mixer outputs ER(IF), EL(IF) are supplied to the switch 49, and the switch outputs RHC, LHC are supplied to the combiner 50. The combiner 50 recovers the original linear polarized signals EH and EV at a downconverted frequency, according to the formula:

$$HLP=(ER(IF)+EL(IF)\angle-90°)/\sqrt{2} \quad [5]$$

$$VLP=(EL(IF)+ER(IF)\angle-90°)/\sqrt{2}, \quad [6]$$

where HLP and VLP represent the horizontal and vertical linear polarized signals in the IF band, respectively. The switch outputs RHC, LHC and the combiner outputs HLP, VLP are supplied to the selectors 51. The selectors 51 pass through the circular polarized IF signals, RHC and LHC, or the linear polarized IF signals, HLP and VLP, based on a selector signal or mode control (MC) signal from a logic controller 32 which is provided as part of the IF signal generating unit 22.

The logic controller 32 may be implemented in a microprocessor, a microcontroller, or a fusible programmable gate array, for example. The inputs to the logic controller 32 are the downconverter control signals supplied from the antenna controller 17 through the antenna interface unit 12. Based on the downconverter control signals, the logic controller 32 generates the appropriate selector signal (MC), filter selection signal (FS), and frequency synthesizer tuning signal (TC), and specifies the amount of phase shift β that will compensate for the misalignment between the orientation of the horizontal and vertical axes of the satellite broadcast signals and the orientation of the probes 11*a,* 11*b*.

The selector signal may be either a circular mode control signal or a linear mode control signal. A circular mode control signal is generated when the downconverter control signals indicate that the DBS service that has been selected is broadcasting circular polarized RF signals. A linear mode control signal is generated when the downconverter control signals indicate that the DBS service that has been selected is broadcasting linear polarized RF signals.

The filter selection signal (FS) is generated for the bandpass filters 46. This signal determines the frequency band: that is to be passed through the bandpass filters 46. The frequency synthesizer tuning signal controls the frequency synthesizer 52 to generate the LO signal at a frequency that is necessary to downconvert the signals broadcast by the satellite 18 to the IF band. The frequency of the LO signal is controlled in this manner because signals are broadcast at different frequencies in different regions. It is also highly desirable to map the signal to the same IF used in a given region so that off-the-shelf receiver/decoder units for that, region can be used. The logic controller 52 generates this tuning signal in accordance with the frequency band of satellite transmission that is specified for the satellite 18 in the downconverter control signals.

The amount of phase shift β is controlled to be dependent on the orientation of the probes 11*a,* 11*b* relative to the orientation of the satellite. The orientation of the probes 11*a,* 11*b* is derived based on the aircraft's global position and attitude, the elevation and azimuth positions of the antenna 11, and the satellite's global position. The orientation of the satellite 18 is determined from the position of the satellite 18 as specified in the downconverter control signals.

The IF signals that are generated by the IF signal generating unit 22 are supplied to the antenna interface unit 12 over two output transmission lines 56*a,* 56*b*. Using the same two output transmission lines 56*a,* 56*b* but in the reverse direction, the antenna interface unit 12 supplies the IF signal generating unit 22 with the downconverter DC power and the downconverter control signals. This is achieved by arranging two bias-T connectors 54, 55 respectively in the two output transmission lines 56*a,* 56*b*. Each of the bias-T connectors 54, 55 has three ports. The first port is an input port for the IF signals. The second port is a common port that is used as an output port for the IF signals and an input port for the downconverter DC power/control signals received from the antenna interface unit 12. The third port is an output port for extracting the downconverter DC power/control signals received from the antenna interface unit 12. The extracted DC power is supplied to the power supply 56 and the extracted control signals are supplied to the logic controller 32.

Figure 4:
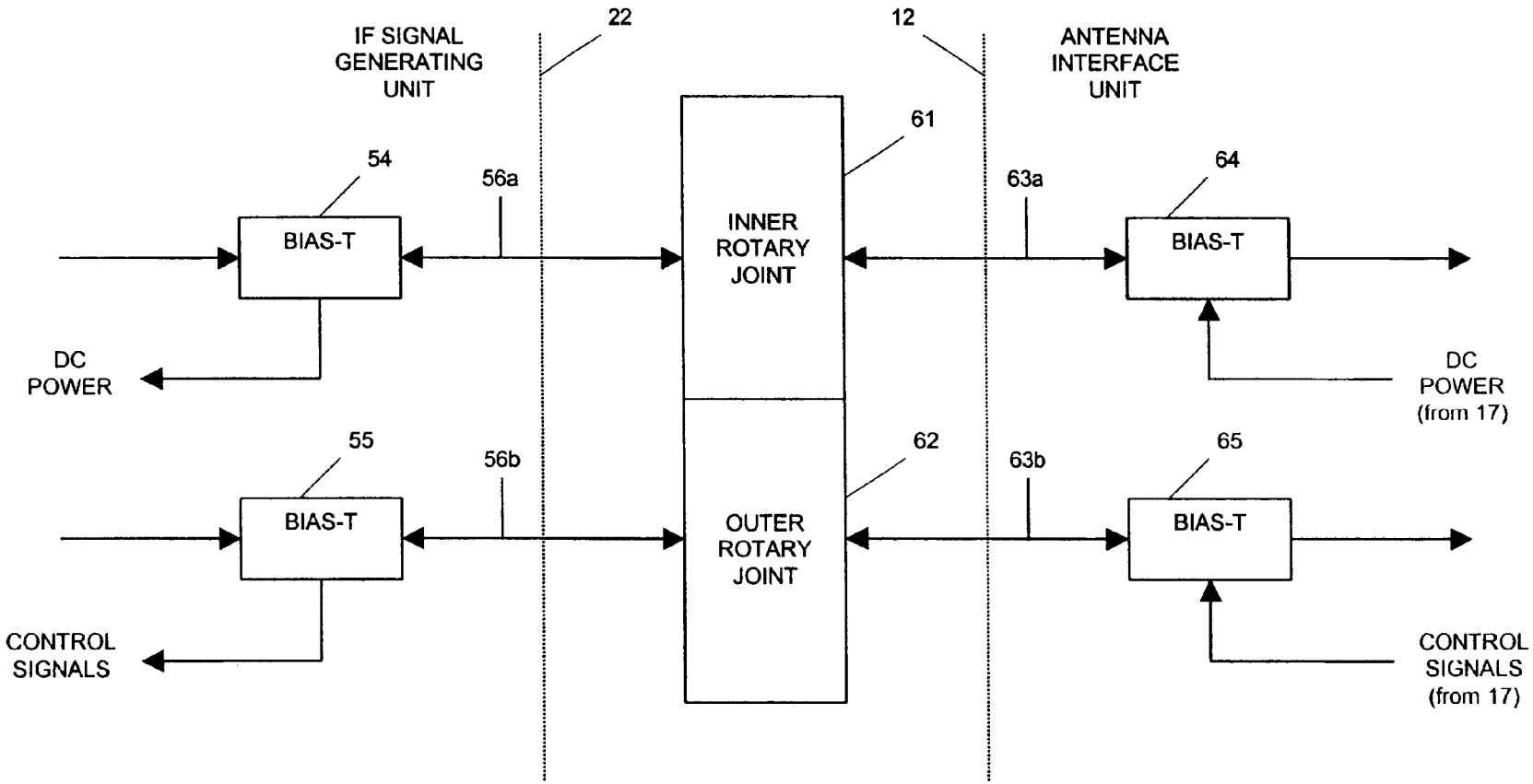
FIG. 4 is a schematic diagram of a rotary connection employed in the IFE system according to the invention.

FIG. 4 shows a block diagram of the electrical connection between the IF signal generating unit 22 and the antenna interface unit 12 employed in the vehicle entertainment system 10 of FIG. 1. The electrical connection between the IF signal generating unit 22 and the antenna interface unit 12 is a rotary connection because the IF signal generating unit 22 rotates with the antenna 11 with respect to the aircraft whereas the antenna interface unit 12 is fixed with respect to the aircraft.

The rotary connection includes an inner rotary joint 61 and an outer rotary joint 62. Linear or circular polarized IF signals are transmitted from the IF signal generating unit 22 to the antenna interface unit 12 over the output transmission lines 56*a,* 56*b* through the inner rotary joint 61 and the outer rotary joint 62. The downconverter DC power is transmitted from the antenna interface unit 12 to the IF signal generating unit 22 in the opposite direction through the inner rotary joint 61 and the downconverter control signals are transmitted from the antenna interface unit 12 to the IF signal generating unit 22 in the opposite direction through the outer rotary joint 62. Alternatively, the rotary connection between the IF signal generating unit 22 and the antenna interface unit 12 may be a slip ring.

Two additional bias-T connectors 64, 65 are arranged in transmission lines 63*a,* 63*b* of the antenna interface unit 12. The bias-T connector 64 couple the downconverter DC power onto the transmission line 63*a* and the bias-T connector 65 couple the downconverter control signals onto the transmission line 63*b*. Each of the bias-T connectors 64, 65 has three ports. The first port is an output port for the IF signals. The second port is a common port that is used as an input port for the IF signals and an output port for the downconverter DC power/control signals that are coupled onto the transmission lines 63*a,* 63*b*. The third port is an input port for the downconverter DC power/control signals. As described above with respect to FIG. 2, the downconverter DC power and the downconverter control signals are supplied to the antenna interface unit 12 from the antenna controller 17.

It is to be understood that the described embodiments are merely illustrative of some of the many specific embodiments that represent applications of the principles of the present invention. Clearly, numerous and varied other arrangements may be readily devised by those skilled in the art without departing from the scope of the invention.

What is claimed is:

1. A vehicle entertainment system, comprising:

an antenna for receiving broadcast signals;

a downconverter for producing intermediate frequency (IF) signals from the broadcast signals based on control signals, said downconverter supplying the IF signals over first and second transmission lines in a first direction and receiving said control signals over one of the first and second transmission lines in a second direction that is opposite to the first direction, wherein the downconverter includes a DC power supply receiving the DC power over the other one of the first and second transmission lines in the second direction that is opposite to the first direction;

a decoder unit for deriving programming signals based on the IF signals;

an antenna interface unit connected between the downconverter and the decoder unit, the antenna interface unit being connected to the downconverter over the first and second transmission lines and providing the control signals and the DC power over the first and second transmission lines in the second direction; and a network for distributing the programming signals to users of the vehicle entertainment system;

wherein the downconverter further includes a first bias-T connector in the first transmission line and a second bias-T connector in the second transmission line, one of the first and second bias-T connectors receiving the control signals from the antenna interface unit, and the other one of the first and second bias-T connectors receiving the DC power from the antenna interface unit.

2. The vehicle entertainment system according to claim 1, wherein the control signals indicate vehicle position and attitude.

3. The vehicle entertainment system according to claim 1, wherein the control signals indicate antenna position.

4. The vehicle entertainment system according to claim 1, wherein the control signals indicate whether the broadcast signals are transmitted in circular polarized form or linear polarized form.

5. The vehicle entertainment system according to claim 1, wherein the antenna interface unit includes a third bias-T connector in the first transmission line and:a fourth bias-T connector in the second transmission line, one of the third and fourth blas-T connectors coupling the control signals onto one of the first and second transmission lines, and the other one of the third and fourth bias-T connectors coupling the DC power onto the other one of the first and second transmission lines.

6. The vehicle entertainment system according to claim 1, wherein the downconverter is movable with the antenna relative to the vehicle and the antenna interface unit is fixed relative to the vehicle.

7. The vehicle entertainment system according to claim 6, further comprising a rotary connector having inner and outer rotary joints, the inner rotary joint being connected to one of the first and second transmission lines and the outer rotary joint being connected to the other one of the first and second transmission lines.

8. A intermediate frequency (IF) signal generating unit for producing IF signals from high frequency signals based on control inputs, comprising:

first and second input lines over which the high frequency signals are received;

first and second output lines over which the IF signals are transmitted, wherein DC power is used to produce the IF signals is received over the second output line;

a controller for producing the control inputs based on control signals received over the first output line; and a first bias-T connector in the first output line and a a second bias-T connection in the second output line, the first bias-T connector receiving the control signals over the first output line and veing connected to the controller to supply the control signals to the controller and the second bias-T connector receiveing the DC power over the second output line.

9. IF signal generating unit according to claim 8, wherein the control signals indicate whether the high frequency signals are in circular polarized form or linear polarized form.

* * * * *